US007093825B2

(12) United States Patent
Kawamura et al.

(10) Patent No.: US 7,093,825 B2
(45) Date of Patent: Aug. 22, 2006

(54) HANDRAIL

(75) Inventors: Osamu Kawamura, Hokkaido (JP); Masao Nakazawa, Hokkaido (JP)

(73) Assignee: Anecom Japan. Co., Ltd., Hokkaido (JP)

( * ) Notice: Subject to any disclaimer, the term of this patent is extended or adjusted under 35 U.S.C. 154(b) by 72 days.

(21) Appl. No.: 10/406,674

(22) Filed: Apr. 3, 2003

(65) Prior Publication Data

US 2003/0193048 A1 Oct. 16, 2003

(30) Foreign Application Priority Data

Apr. 12, 2002 (JP) ..... 2002-110867

(51) Int. Cl.
*E04F 11/18* (2006.01)

(52) U.S. Cl. ..... 256/59; 403/65.01; 403/65.16; D25/119; D25/164

(58) Field of Classification Search ..... 256/1, 256/19, 59, 65.06; 198/337; D25/119, 164, D25/38; 211/105.1; 248/251
See application file for complete search history.

(56) References Cited

U.S. PATENT DOCUMENTS

| | | | | |
|---|---|---|---|---|
| 3,168,170 | A * | 2/1965 | Thom | 256/59 |
| 3,842,564 | A * | 10/1974 | Brown | 256/59 |
| 4,002,322 | A * | 1/1977 | Matsubara | 256/65.06 |
| 4,007,918 | A * | 2/1977 | Matsubara | 256/59 |
| 4,220,316 | A * | 9/1980 | Naka et al. | 256/59 |
| 4,646,490 | A * | 3/1987 | Naka et al. | 256/59 |
| 5,469,682 | A * | 11/1995 | Knight | 256/59 |
| 5,713,171 | A * | 2/1998 | Andres | 256/59 |
| 6,209,854 | B1 * | 4/2001 | Sedlack et al. | 256/59 |
| 6,270,058 | B1 * | 8/2001 | Williams et al. | 256/59 |

FOREIGN PATENT DOCUMENTS

| | | | |
|---|---|---|---|
| GB | 567071 | A * | 1/1945 |
| GB | 1444734 | A * | 8/1976 |
| JP | 1-322054 | * | 12/1989 |
| JP | 10-219955 | | 8/1998 |
| JP | 10-266514 | | 10/1998 |
| JP | 11-236755 | | 8/1999 |
| JP | 2001-032493 | | 2/2001 |
| JP | 2001-146828 | | 5/2001 |
| JP | 2002-115381 | | 4/2002 |
| JP | 2003-301582 | * | 10/2003 |

OTHER PUBLICATIONS

JP2000-240249; Japanese Patent Publication, Sep. 5, 2000.*
JP2003-64838; Japanese Patent Publication, Mar. 5, 2003.*

* cited by examiner

*Primary Examiner*—Daniel P. Stodola
*Assistant Examiner*—Ernesto Garcia
(74) *Attorney, Agent, or Firm*—Howson and Howson

(57) ABSTRACT

A handrail for preventing dangers during walking and movements to standing or sitting positions, for correcting postures, and for simplifying walking movements of physically handicapped persons, persons with weak grip strength, and persons of low functional capacity caused by collagenosis or rheumatism. The handrail is an elongate handrail having a smooth curved line periphery. The pinky-engaging side of the handrail is protuberated in a circular shape and has a recess at a portion thereof where a fingertip of a person grasping the handrail engages a lower end vicinity position of the circular shape.

5 Claims, 3 Drawing Sheets

HANDRAIL

FIELD OF THE INVENTION

The present invention relates to a handrail, and more particularly, the present invention relates to a handrail that provides an aid for walking and for movements to a standing or sitting position for physically handicapped persons, persons with weak grip strength, and persons of low functional capacity caused by collagenosis or rheumatism.

BACKGROUND OF THE INVENTION

Conventionally, handrails are used for the purpose of aiding walking or preventing a person from falling or tumbling when traversing a flat floor or ascending or descending a stairway.

Various materials are used for manufacturing a handrail. For example, metals such as stainless steel and aluminum, wood, bamboo, and resin including fiber reinforced resin, among others, are used as handrail materials, and the shape of such a handrail is often formed to have a relatively simple cross-section such as a tube or pipe shape, or a shape where the cross section thereof is a round bar shape or a square bar shape. This is based on manufacturing simplicity and cost reduction demands.

In recent years, the number of elderly people is on the rise, and, from the perspective of preventing senescence or deterioration of functional capacity through independent efforts or self-reliance of physically handicapped persons, there are demands in hospitals, nursing homes, public facilities and even general households for improvements in handrails to aid particularly in walking and movements such as standing up from a wheelchair into a standing position or sitting down onto a toilet seat from an upright position for physically handicapped persons, persons with weak grip strength, and persons of low functional capacity caused by collagenosis or rheumatism.

Nevertheless, the conventional purpose of improving handrails is simply to make a handrail of a resin material since a stainless steel handrail is too cold to use in the winter, and since minute unevenness can be formed on the surface of a resin handrail to prevent a hand from slipping on the handrail when the handrail is wet. In addition, a resin handrail has been used since an antibacterial coating can be applied to the resin handrail. However, the known handrails capable of aiding walking and movements to a standing or sitting position as described above for physically handicapped persons, persons with weak grip strength, and persons of low functional capacity caused by collagenosis or rheumatism have not been realized.

As specific functions of a handrail, for instance, there are 1) a function of aiding movements or preventing dangers upon gripping the handrail or placing one's hand on the handrail in emergency situations when there is danger of the body falling while walking on a flat floor or stairs; 2) an aiding function for aiding a person of low functional capacity, in particular, a person having depressions in bones, muscles and muscular strength when such person walks with a hand placed on the handrail or in a state in which an entire arm including the elbow is placed on the handrail so that unstable postures of staggering or wobbling of the body are corrected during the walk; 3) an aiding function for aiding a person of low functional capacity, in particular, a person having depressions in bones, muscles and muscular strength when such person places a hand on the handrail when standing up into a standing position from a sitting position or from a toilet seat or in a state in which an entire arm including the elbow is placed on the handrail so that unstable postures of staggering or wobbling of the body are corrected and a corrected posture is maintained; 4) an aiding function for aiding a person of low functional capacity, in particular, a person having depressions in bones, muscles and muscular strength when such person places a hand on the handrail when moving from a standing position to a sitting position such as onto a toilet seat or in a state in which an entire arm including the elbow is placed on the handrail so that unstable postures of staggering or wobbling of the body are corrected and prevent accidents such as falls; and 5) a function for preventing dangers such as the body falling from high places or upon notifying the danger area in the likes of a vaulted structure or stairwell.

Generally speaking, conventional handrails that have a round, tubular or square cross section are basically useful for functions 1) and 5) described above. Nevertheless, with respect to foregoing functions 2), 3) and 4), such conventional handrails are basically useless for physically handicapped persons or persons of low functional capability. This is an extremely critical issue. There is even fear that such conventional handrails may complicate walking and movements to a standing or sitting position, and may make a person fall.

OBJECTS OF THE INVENTION

In light of the foregoing problems, an object of the present invention is to provide a handrail, in particular, a handrail capable of preventing dangers during walking movements or movements to a standing or sitting position, correcting postures, and simplifying the walking of physically handicapped persons, persons with weak grip strength, and persons of low functional capacity caused by collagenosis or rheumatism.

SUMMARY OF THE INVENTION

The present inventors discovered that the correction of posture and simplification of walking can be achieved, and the foregoing problems could be overcome by devising the cross section shape of a long handrail.

Based on the foregoing discovery, the present invention provides a long handrail having a smooth curved line periphery. The periphery includes a side face of the handrail that forms a pinky-engaging side of the handrail. The side face has a protuberant circular shape and a recess at a lower end vicinity position thereof where a fingertip of a person grasping the handrail engages the handrail.

According to another aspect of the present invention, a long handrail is provided having a smooth curved line periphery, and the periphery includes a side face of the handrail that forms a thumb-engaging side of the handrail. The side face gradually protrudes outwardly and has a recess only at a portion where a thumb of a person grasping the handrail is to be positioned.

According to yet another aspect of the present invention, a long handrail is provided having a smooth curved line periphery, and the periphery includes an upper face portion having a shallow recess.

According to a still further aspect of the present invention, the periphery of the long handrail includes a lower face that is engaged and supported by a handrail support. The lower face of the handrail and an upper face of the handrail support are complementary circular or oval shapes so that an angle and positioning of the handrail relative to the handrail support is adjustable.

DESCRIPTION OF THE PREFERRED EMBODIMENTS

Figure 1:
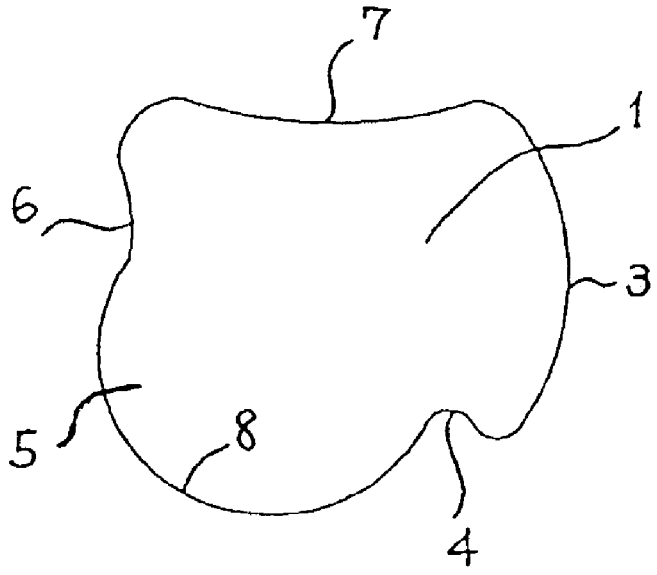
FIG. 1 is a diagram showing the cross section of a handrail illustrating an example of the present invention.
Figure 2:
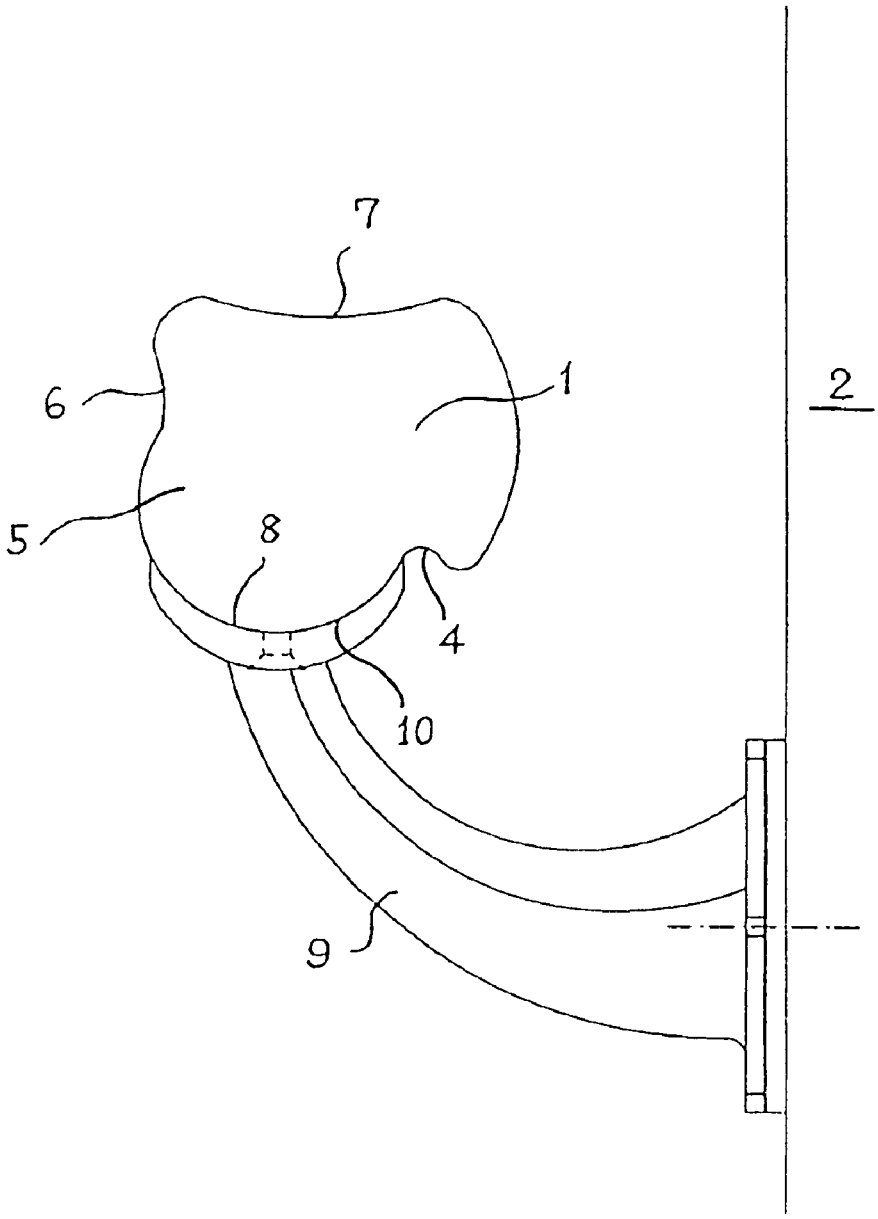
FIG. 2 is a diagram showing the cross section structure upon supporting the handrail according to the present invention with a support.
Figure 3:
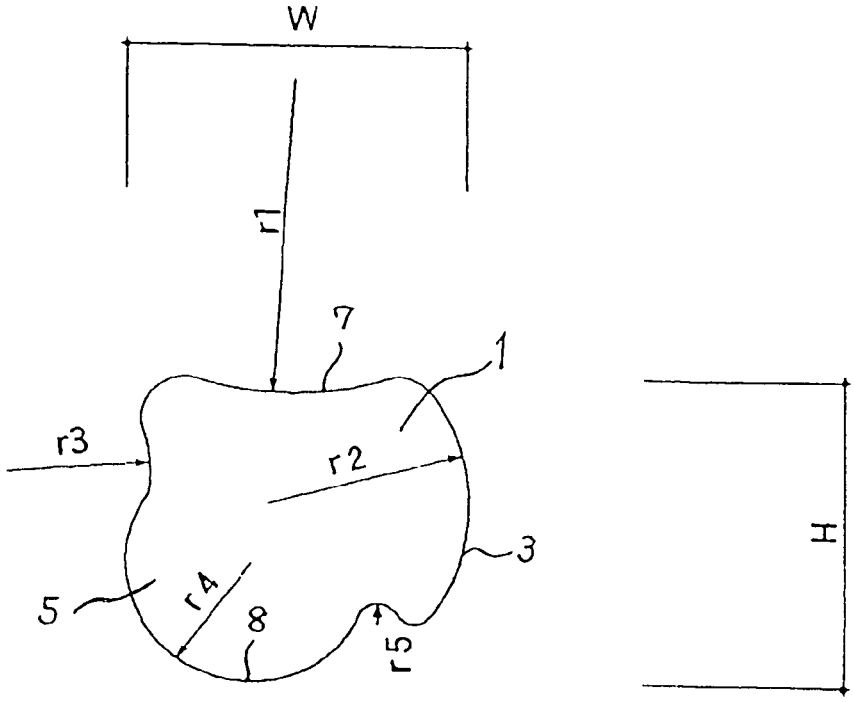
FIG. 3. is a diagram explaining the outside dimensions of the handrail according to the present invention.

An example of the present invention is now explained with reference to the drawings. FIG. 1 shows a cross section of a representative handrail according to the present invention, and FIG. 2 shows a cross section of a portion of the handrail that is fixed to a support.

Generally, as described above, a handrail functions as an aiding apparatus for walking along a certain area or as a fence or the like for preventing dangers. The long handrail employed in the present invention is a handrail having a suitable length that can be disposed along such an area. Thus, the present invention includes handrails that are curved or bent, handrails disposed in upper and lower multi-stages, and handrails in which several handrails are disposed intermittently, among others, and there is no particular limitation on the disposition or overall structure of such handrails upon employing the present invention.

Although it is preferable that the cross-sectional shape of the handrail is even in the longitudinal direction of the handrail from the perspective of simplifying the manufacture, the cross section is not necessarily limited to being even. For instance, since the function of the handrail slightly differs during the change in movement from a standing position to a sitting position or vice versa, and during walking, the cross-sectional shape of the handrail may be varied in accordance with the situation and frequency of such movement. The present invention covers all such shapes of a handrail.

Moreover, the present invention may be fabricated of any materials including, for example, metal such as stainless steel or aluminum, wood, bamboo, resin including fiber reinforced resin, and wooden materials that can be processed easily.

As depicted in FIG. 1 and FIG. 2, the periphery of the handrail 1 according to the present invention has a smooth curved line and is asymmetrical. Here, the periphery of the handrail 1 shall mean the periphery in the transverse cross-section of the elongate handrail. Height H in the cross-section of the handrail is suitably 25 to 90 mm (1 to 3.5 inches) in consideration of ease of holding, and more preferably is in a range of 35 to 55 mm (1.4 to 2.2 inches). Moreover, the width W of the foregoing cross-section is 30 to 90 mm (1.2 to 3.5 inches), and more preferably 40 to 65 mm (1.6 to 2.6 inches).

The pinky side of the handrail facing the wall 2 on which the pinky of a person grasping the handrail is located has a protuberant circular shape and a recess 4 at the lower end vicinity position of this circular portion 3.

When holding the handrail shown in the drawings with the right hand, the gradually protuberant circular portion 3 has a curvature for enabling a natural opening of the hand or natural holding (gripping) figuration upon holding the handrail at the position of the fingers from the index finger to the pinky of the right hand or hollow of the hand (palm). This curvature radius "r2" is suitably 20 to 50 mm (0.8 to 2 inches), and more preferably 25 to 45 mm (1 to 1.8 inches).

The recess 4 at the lower end vicinity position of the foregoing circular portion 3 is a significant characteristic of the present invention, and this recess 4 is provided at a position where the fingertips of fingers from the index finger to the pinky of the right hand directly fit therein. The curvature radius "r5" of this recess 4 is suitably 1 to 15 mm (0.04 to 0.6 inch), and more preferably 2 to 10 mm (0.08 to 0.4 inch).

The size of palms differs slightly per person or based on the difference of adults and children, and there are also cases where the hand function varies considerably depending on the difference between able-bodied persons and persons of low functional capacity, or on the degree of such low functional capacity.

In such case, it is necessary to determine the size and shape of the handrail in correspondence with the user. Nevertheless, in most cases, it is desirable to design the handrail in correspondence with persons having a more serious loss of function, and many functions of the present invention can be achieved in a broad range. This type of handrail possesses the function of enabling able-bodied persons to walk steadily or retain one's posture in addition to persons of low functional capacity.

With persons suffering of loss of hand function, there are cases where only one to three fingers move among the five fingers, and the other fingers do not move. In such a case, even if the number of effective fingers is few, the recess 4 at the lower end vicinity position of the circular shape 3 will become a strong grip for the fingers, and an extremely powerful support for correcting the posture or supporting the body. In this regard, the recess 4 plays a significant role.

Generally, a conventional handrail having a round cross section shape has no variation in the shape thereof, and there is a problem in that the user is not able to recognize at which part of the handrail he/she should place the strength into one's fingers. In other words, if the user is not of a condition in which the user is able to grip the handrail simultaneously with one's thumb and fingers when holding such a handrail, the user will not be able to hold the handrail in a stable manner and with a safe conscience. Thus, handrails having a round cross section contribute a sense of insecurity particularly to persons with weak grip strength and therefore, are of an inappropriate shape.

Contrarily, the recess 4 of the present invention increases the reliability of gripping where the fingers are not released easily, and the user feels a sense of recognition of the gripping spot and that one's fingers have reached the gripping position when touching or pressing against the recess 4. This is an extremely important aspect, and it is thereby possible to provide a feeling of security for gripping and enable certain and stable gripping in particular to those with weak grip strength.

Moreover, with the present invention, the thumb side of the handrail on which the thumb of a person grasping the handrail is located, that is, the side face of the handrail opposite the wall 2, gradually protrudes outwardly so as to form a protuberance 5 along the shape of the palm. A recess 6 is further provided in this side face only at the portion where the thumb is to be positioned.

The curvature radius "r4" of the protuberance 5 is 10 to 40 mm (0.4 to 1.6 inches) and more preferably 15 to 35 mm (0.6 to 1.4 inches). The user will thereby be able to grip the handrail in a state where it fits the palm naturally.

The recess 6 allows the thumb, in particular, and other fingers to strongly grip the handrail so as to sandwich both sides thereof. The curvature radius "r3" of the recess 6 is 10 to 50 mm (0.4 to 2 inches), and more preferably 15 to 35 mm (0.6 to 1.4 inches).

The recess 6 coincides with the shape and position of the thumb of a hand grasping the handrail and is located closer to the upper face of the handrail than to the lower face of the handrail (see FIG. 1). Thus, the recess 6 extends approximately parallel to the longitudinal direction of the handrail, enables natural gripping of the handrail, and allows persons with low functional capacity to hold the handrail with ease and in a secure manner.

The handrail of the present invention further comprises a shallow recess 7 at an upper face portion of the handrail. The shallow recess 7 represents a significant characteristic of the present invention. For persons of low functional capacity, the movement from the sitting position to the standing position or vice versa is an extremely difficult task. In particular, this places a considerable burden on the knees and waist, and, when there are abnormalities in such parts, there are cases where the movement itself becomes difficult.

The handrail of the present invention not only allows the palm of the hand to be placed thereon, but also permits the entire arm to be placed and supported on the handrail, and the user may conduct the movement from a sitting position to a standing position or vice versa while placing his/her weight on one's arm. With conventional handrails having a round bar or square shape, there are cases where the arm easily slips off the handrail. Nevertheless, if the curvature of the recess 7 is too large, the function as a handrail for providing a smooth feeling when walking will deteriorate, and therefore, the recess 7 is formed shallow. The curvature radius "r1" of the recess 7 is 35 to 90 mm (1.4 to 3.5 inches), and a more preferably 40 to 65 mm (1.6 to 2.6 inches).

Further, as shown in FIG. 2, the lower face 8 of the handrail and the upper face 10 of the support 9 are formed in a complementary circle or oval shape. Thereby, the angle and position of the handrail can be adjusted relative to the support 9. The support 9 shown in FIG. 2 is an ordinary support, and the handrail of the present invention can be easily mounted by using this kind of existing support 9.

In hospitals, nursing homes or residential care institutions, there are cases where many persons of similar low functional capacity reside. In such a case, the position of the foregoing recesses 4, 6, 7, circular portion 3 and protuberance 5 may be changed so as to adjust such position to match persons with particular low functional capacity.

In such a case, although costs will increase to exchange the entire handrail, there are cases where this may be resolved by merely adjusting the angle and position of the handrail as described above. From this respect, by forming the lower face 8 or the handrail and the upper face 10 of the support 9 in a complementary circle or oval shape, the position of the grip can be changed, and this possesses great significance. The present invention also comprises a function of changing the position or structure with ease.

As described above, the handrail of the present invention has a unique cross-sectional structure. And, by adding, even independently, the recesses 4, 5, 7, circular portion 3 and protuberance 5 to a conventional handrail, a significant function can be yielded.

Nevertheless, when there are two or more of the above; more specifically, when these are integrally provided including the lower face 8 of the foregoing handrail, the handrail function can be improved considerably. The present invention covers the foregoing combinations and every comprehensive mode thereof.

Moreover, the handrail of the present invention has a user-friendly structure, and is a structure that may also be used by able-bodied persons. Therefore, the present invention may be used for indoor and outdoor structures and buildings, for instance, inside buildings, station yards, airports, department stores, theaters, entertainment halls, on bridges, and so on, and the present invention may also be used in general households.

Further, although the measurements of foregoing recesses 4, 6, 7, circular portion 3 and protuberance 5 are favorable measurements in consideration mainly for persons of low functional capacity, measurements other than those described above may also be adopted in accordance with the mode of use. The present invention covers all such measurements.

In addition to possessing the standard functions of a handrail, that is, the function of aiding movements or preventing dangers when the handrail is gripped or when placing one's hand on the handrail in emergency situations when there is danger of the body falling while walking on a flat floor or stairs and the function of preventing dangers such as the body falling from high places or upon notifying the danger area in the likes of a vaulted structure or stairwell, the handrail according to the present invention yields superior effects. To this end, the handrail of the present invention further provides an aiding function for aiding a person of low functional capacity, in particular, a person having depressions in bones, muscles and muscular strength when such person walking with one's hand placed on the handrail or in a state in which the entire arm including the elbow is placed on the handrail such that unstable postures of staggering or wobbling of the body are corrected during the walk. In addition, the handrail of the present invention provides an aiding function for aiding the foregoing person when such person places a hand on the handrail when standing up into a standing position from a sitting position, or from a toilet seat, or when moving from a standing position to a sitting position, such as onto a toilet seat, or in a state in which the entire arm of the person including the elbow is placed on the handrail such that unstable postures of staggering or wobbling of the body can be corrected.

Accordingly, it is a possible aid in the self-reliance of preventing senescence or deterioration of functional capacity through independent efforts of physically handicapped persons, person with weak grip strength, and persons of low functional capacity caused by collagenosis or rheumatism, and, in particular, a significant effect is yielded in that the present invention may be employed in hospitals, nursing homes, public facilities and general households.

The invention claimed is:

1. A handrail, comprising:

a long handrail having an asymmetrical smooth curved line periphery in transverse cross-section, said periphery having an upper face portion and a lower face, and a handrail support having an upper face that engages said lower face of said handrail to support said long handrail, said lower face of said handrail and said upper face of said handrail support having complementary circular shapes so that an angle and a position of said handrail relative to said handrail support is adjustable, said periphery including a side face of the handrail forming a piniky-engaging side of the handrail that has a protuberant circular shape and that has an upwardly-extending recess at a lower end vicinity position of said circular shape, and said periphery including an opposite side face forming a thumb-engaging side of the handrail that has a longitudinally-extending recess that is located closer to said upper face portion than said lower face and that is adapted for a person's thumb placed approximately parallel to a longitudinal axis of the handrail when the person grasps the handrail.

2. A handrail according to claim 1, wherein said upper face portion of said handrail extends between said thumb-engaging side and said pinky-engaging side, and wherein said upper face portion of said handrail has a shallow recess formed therein.

3. A handrail, comprising:

a long handrail having an asymmetrical smooth curved line periphery including an upper face portion and a lower face, and a handrail support having an upper face that engages said lower face of said handrail to support said long handrail, said lower face of said handrail and said upper face of said handrail support having complementary circular shapes so that an angle and a position of said handrail relative to said handrail support is adjustable, said periphery including a side face of the handrail forming a thumb-engaging side of the handrail that has a longitudinally-extending recess that is located closer to said upper face portion than said lower face and that is adapted for a person's thumb placed approximately parallel to a longitudinal axis of the handrail when the person grasps the handrail, said periphery including a piniky-engaging side face opposite said thumb-engaging side and having a fingertip-receiving recess, said recess on said thumb-engaging side is located at a higher elevation on said periphery than said recess on said pinky-engaging side face, and said upper face portion having a shallow recess formed therein.

4. A handrail according to claim 3, wherein said recess on said pinky-engaging side face is located on a lower half of said periphery.

5. A handrail according to claim 4, wherein said thumb-engaging side of said periphery below said thumb-engaging recess is formed at a radius of curvature.

* * * * *